US006896328B2

(12) United States Patent
Goodworth

(10) Patent No.: US 6,896,328 B2
(45) Date of Patent: May 24, 2005

(54) STEEL WIRE CHAIR WITH SPRINGS

(75) Inventor: William H. Goodworth, Davenport, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/323,218

(22) Filed: Dec. 18, 2002

(65) Prior Publication Data

US 2004/0119325 A1 Jun. 24, 2004

(51) Int. Cl.[7] ..... A47C 1/032; A47C 1/024

(52) U.S. Cl. ..... 297/302.3; 297/297; 297/325

(58) Field of Search ..... 297/296, 297, 297/301.1, 301.3, 302.3, 313, 325

(56) References Cited

U.S. PATENT DOCUMENTS

| | | | | | |
|---|---|---|---|---|---|
| 475,788 | A | * | 5/1892 | Miller | 5/110 |
| 802,249 | A | * | 10/1905 | White | 280/31 |
| 1,491,918 | A | * | 4/1924 | Nolan | 297/295 |
| 1,950,226 | A | | 3/1934 | Cable | |
| 2,353,737 | A | * | 7/1944 | Lorenz | 297/300.4 |
| 2,537,071 | A | * | 1/1951 | Lukins | 297/294 |

(Continued)

FOREIGN PATENT DOCUMENTS

| | | |
|---|---|---|
| BE | 524012 | 11/1953 |
| CA | 1184108 | 3/1985 |
| DE | 626080 | 8/1936 |

OTHER PUBLICATIONS www.steelcase.com, Jul. 18, 2001, 1 page.
www.troelsgrum–schwensen.com, Jul. 16, 2001, 2 pages.
www.fixturesfurniture.com, Aug. 8, 2001, 2 pages.
www.virco.com, Jul. 16, 2001, 1 page.
www.virco.com, Aug. 8, 2001, 1 page.
www.visualibrary.com, Feb. 27, 2002, 1 page.
www.troelsgrum–schwensen.com, Mar. 6, 2001, 1 page.
www.plantationpatterns.com, Oct. 1, 2001, 2 pages.
www.unitedchair.com, Jul. 2001, 1 page.
www.meritalia.it.it/sedie/eng, Aug. 16, 2001, 1 page.
www.troelsgrum–schwensen.com, Jul. 24, 2001, 1 page.
www.scottriceok.com, Jul. 16, 2001, 1 page.
www.psgerry.com, Sep. 27, 2001, 2 pages.

*Primary Examiner*—Peter M. Cuomo
*Assistant Examiner*—Joseph Edell
(74) *Attorney, Agent, or Firm*—Ronald A. Sandler; Jones Day

(57) ABSTRACT

The stylish task chair includes a base with casters, a mounting plate, a seat frame, a back frame, a pair of springs and a seat and backrest. The frames are formed of steel wire of seven-sixteenth inch diameter. The chair is formed by welding the springs to the seat frame and the mounting plate and by welding the back frame to the mounting plate, the back frame being contiguous with the springs. A seat panel is fastened to the seat frame and a backrest panel is mounted to the back frame. Two horizontally disposed steel wires are welded to the back frame and support armrests. The spring allows the rearward portion of the seat to pivot and the cantilevered back frame allows the backrest to flex, these pivoting and flexing movements being independent of each other. The steel wire offers comfort and an airy open look. Seat and backrest cushions may be connected to the panels.

30 Claims, 8 Drawing Sheets

U.S. PATENT DOCUMENTS

| | | | | | |
|---|---|---|---|---|---|
| 2,602,489 | A | | 7/1952 | Holten | |
| 3,475,054 | A | | 10/1969 | Flint | |
| D272,020 | S | * | 1/1984 | Baty | D6/344 |
| D279,246 | S | | 6/1985 | Murry | |
| 4,575,150 | A | * | 3/1986 | Smith | 297/300.4 |
| 4,786,106 | A | * | 11/1988 | Bottemiller | 297/265.1 |
| 4,830,430 | A | * | 5/1989 | Schafer | 297/298 |
| D303,597 | S | | 9/1989 | Kaminski | |
| D303,598 | S | | 9/1989 | Tornero | |
| 5,383,712 | A | * | 1/1995 | Perry | 297/448.2 |
| D366,089 | S | | 1/1996 | Ackerson, Jr. | |
| 5,664,835 | A | * | 9/1997 | Desanta | 297/302.1 |
| 5,697,673 | A | | 12/1997 | Favaretto | |
| D401,453 | S | | 11/1998 | Holt | |
| D408,161 | S | | 4/1999 | Caruso | |
| 6,056,361 | A | * | 5/2000 | Cvek | 297/300.2 |
| D435,746 | S | | 1/2001 | Diffrient | |
| D438,392 | S | | 3/2001 | Lucci et al. | |
| D439,452 | S | | 3/2001 | Turner et al. | |
| D440,797 | S | | 4/2001 | Norman | |
| D447,351 | S | | 9/2001 | Sato | |
| D453,633 | S | | 2/2002 | Diffrient | |
| 6,511,128 | B2 | * | 1/2003 | Piretti | 297/300.4 |
| 6,523,896 | B1 | * | 2/2003 | Uhlenbrock | 297/300.4 |
| 2002/0005658 | A1 | | 1/2002 | Piretti | |

* cited by examiner

Fig. 7
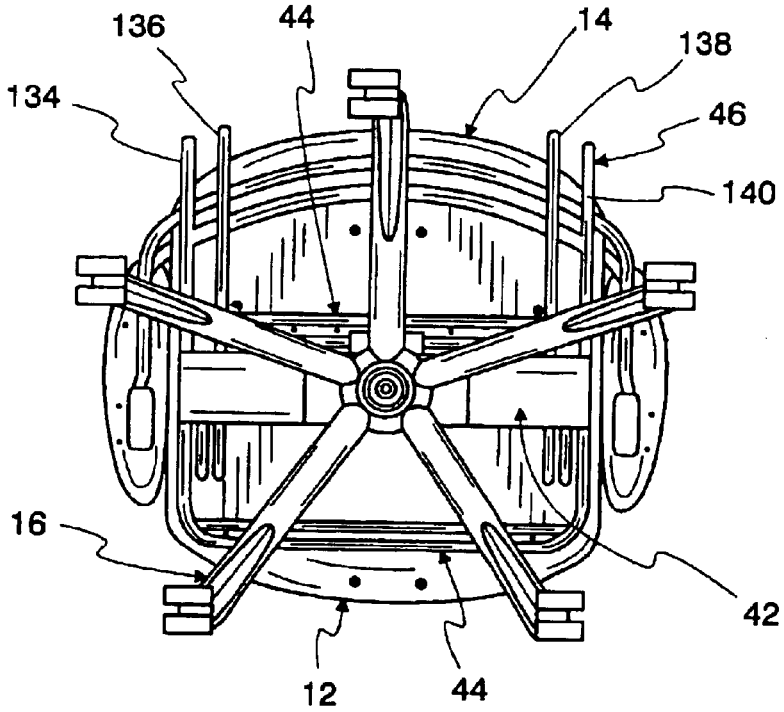
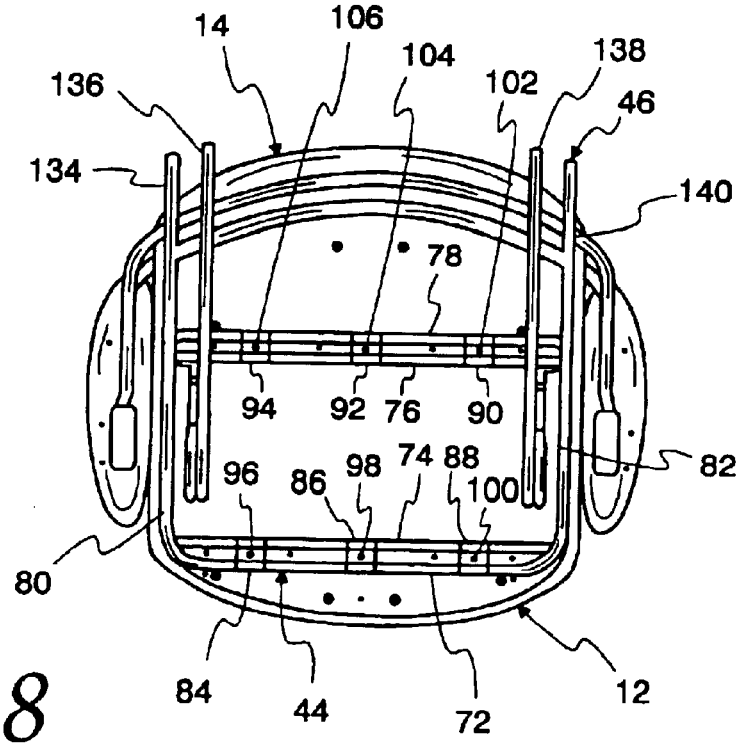
Fig. 8

STEEL WIRE CHAIR WITH SPRINGS

BACKGROUND OF THE INVENTION

CROSS-REFERENCE TO RELATED APPLICATION

Not applicable.

STATEMENT RE FEDERALLY SPONSORED RESEARCH

Not applicable.

1. Field of the Invention

The present invention relates to a steel wire chair with built-in springs, and more particularly, to a comfortable, tiltable task-type chair made of steel wire which is stylish and yet economical.

2. Description of the Related Art

Numerous wire frame chairs are known, each with different architectural styling and offering different features. For example, some wire frame chairs are suitable for stacking, others provide very unusual styling and still others use wire frames for flexibility. See for example, Virco's Virtuoso and I.Q. brand stacking chairs, Steelcase's Uno and Parade brand stacking chairs, PSGI's Activa brand stacking chairs and Features' Emotion brand stacking chairs. Also see United Chairs' Rave brand office chair, Plantation Patterns' patio chair, Keilhauer's Net brand side chair and Neritalia's Isico brand side chair. Additional wire frame chairs are shown in Canadian patent 1,184,108; Belgium patent 524,102; German patent 626,080; U.S. Pat. Nos. 5,697,673; 3,475,054; 1,950,226; D438,392; D447,351; 2,602,489; D303,597; D439,452; D401,453; D435,746; D440,797; D279,246; D303,598; D355,089; D408,161; D453,633 and U.S. Publication 2002/0005658A1.

BRIEF SUMMARY OF THE INVENTION

What is described here is a chair comprising a base, a mounting element connected to the base, a seat frame having a forward end portion and a rearward end portion, a seat connected to the seat frame, a back frame fixed to the mounting element and cantilevered rearwardly and upwardly, a backrest connected to the back frame and a pair of springs fixedly attached to the seat frame between the forward and the rearward end portions of the seat frame and to the mounting element, where the back frame and the pair of springs are formed of metal wire.

There are numerous advantages, features and objects achieved with the present invention which are believed not to be available in the earlier related devices. For example, one advantage is that the present invention provides a chair that is very comfortable, yet economical. Another object of the present invention is to provide a chair that has independent pivoting of the seat and flexing of the backrest. A further advantage of the present invention is that the chair is architecturally stylish, achieving an airy, small look while achieving the above mentioned objects. Yet another feature is that the chair is recyclable.

A more complete understanding of the present invention and other objects, advantages and features thereof will be gained from a consideration of the following description of preferred embodiments read in conjunction with the accompanying drawing provided herein. The preferred embodiments represent an example of the invention which is described here in compliance with Title 35 U.S.C. section 112 (first paragraph), but the invention itself is defined by the attached claims.

BRIEF DESCRIPTION OF THE SEVERAL VIEWS OF THE DRAWING

FIG. 7 is a bottom plan view of the chair shown in FIGS. 1–6.

FIG. 8 is a bottom plan view of the chair shown in FIGS. 1–7 but without a base.

DETAILED DESCRIPTION OF PREFERRED EMBODIMENTS OF THE INVENTION

Figure 1:
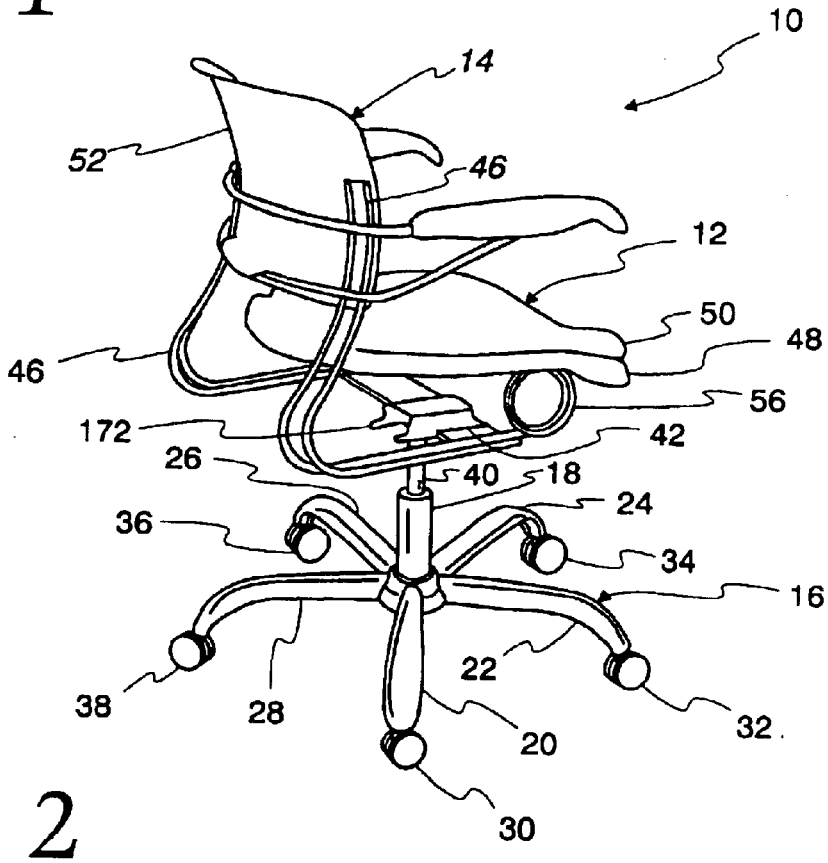
FIG. 1 is a right, rear isometric view of the chair disclosed herein.
Figure 2:
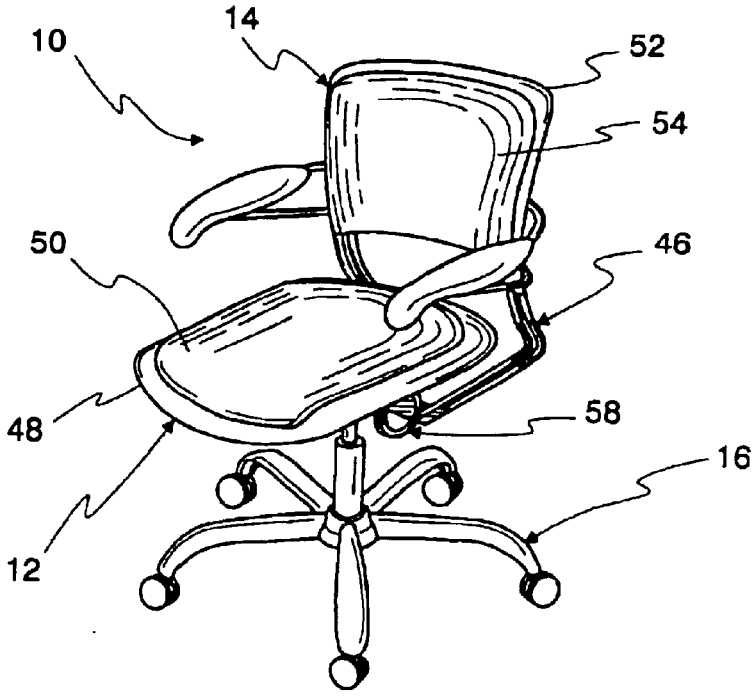
FIG. 2 is a right, front isometric view of the chair shown in FIG. 1.
Figure 3:
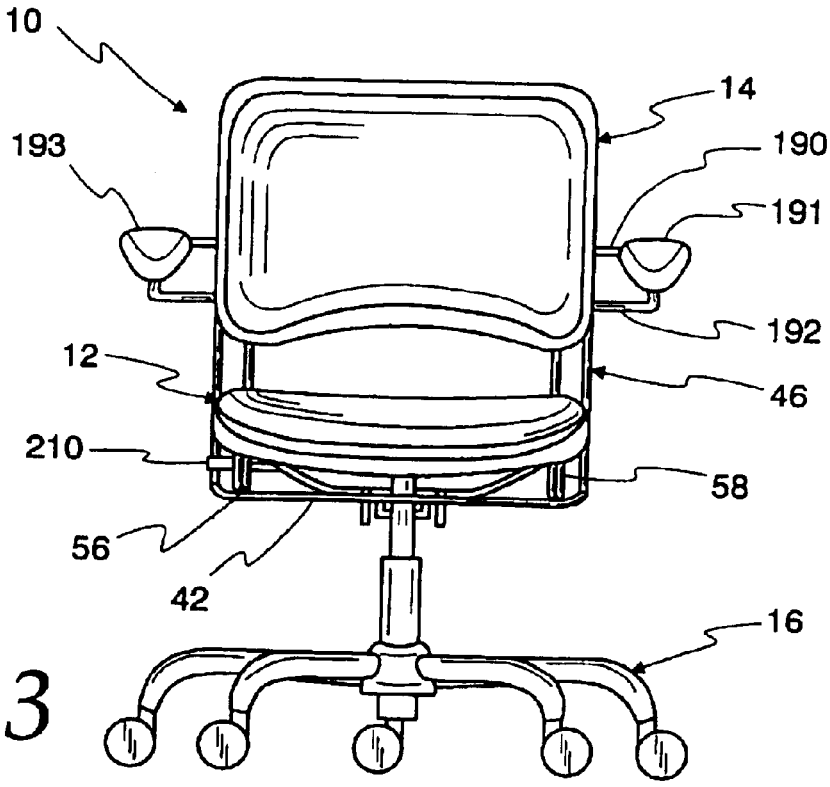
FIG. 3 is a front elevation view of the chair shown in FIGS. 1 and 2.

While the present invention is open to various modifications and alternative constructions, the preferred embodiments shown in the various figures of the drawing will be described herein in detail. It is understood, however, that there is no intention to limit the invention to the particular embodiments, forms or examples disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Figure 9:
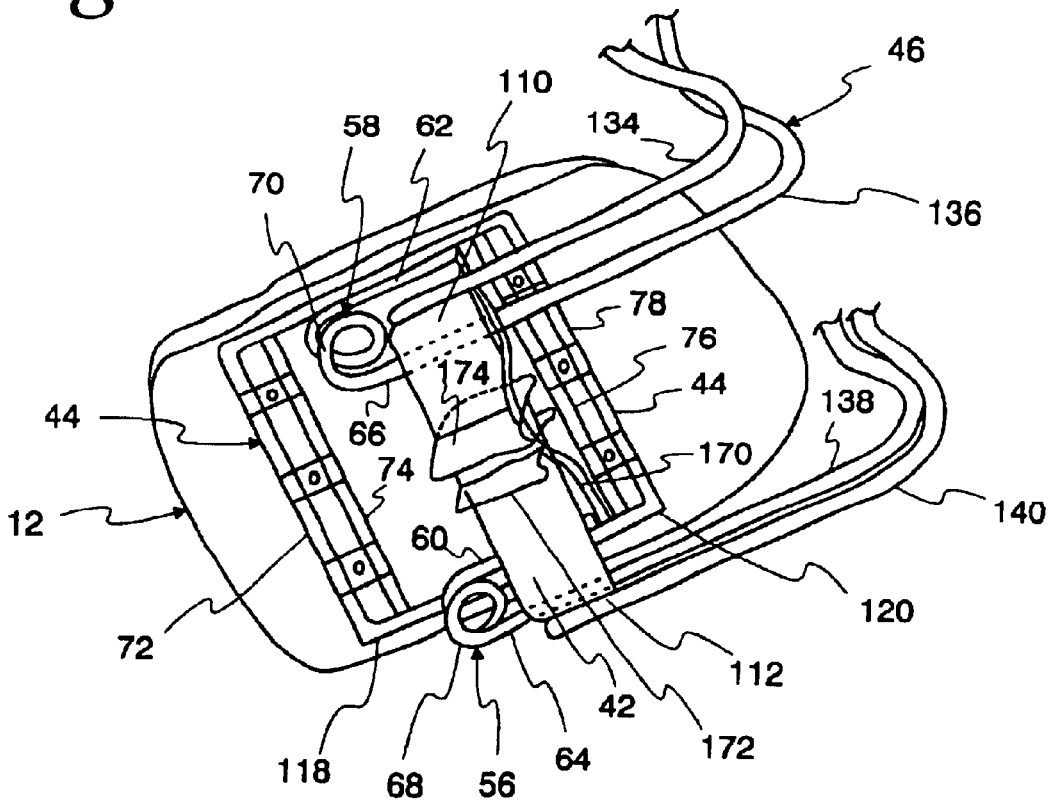
FIG. 9 is an upward looking isometric view of the bottom of the chair shown in FIGS. 1–8 but without a base.

The chair 10, FIGS. 1–7, includes a seat 12, a backrest 14 and a base 16, the base includes a stem 18 which is connected to five spokes 20, 22, 24, 26, 28 and attached casters 30, 32, 34, 36, 38. The base includes a pneumatic cylinder 40 for adjusting the vertical height of the seat and the backrest in the usual manner well understood by those skilled in the art. The chair further includes a mounting element in the form of a plate 42, a seat frame 44, FIGS. 7–9, and a back frame 46. The seat 12 includes a seat panel 48 and a seat cushion 50 and the backrest 14 includes a backrest panel 52 and a backrest cushion 54.

Mounted beneath the seat 12 are a pair of spaced apart springs 56, 58. The springs each include an upper arm portion 60, 62, FIGS. 5, 6 and 9, lower arm portions 64, 66 and curved portions 68, 70 in the form of a loop or coil that extends about five hundred and forty degrees, a circle and a half. The springs are disposed in a generally vertical orientation and are formed of steel wire having a seven-sixteenth inch diameter. The seat frame 44 is also formed of steel wire approximately seven-sixteenth inch in diameter and is arranged in a rectangular configuration including two front, laterally extending sides 72, 74, FIGS. 8 and 9, and two rear, laterally extending sides 76, 78 and two front-rear extending sides 80, 82. All six side members are either welded to each other or to the extent convenient, formed of a single wire bent to the configuration shown. The seat frame is connected to the seat panel 48 with six brackets 84, 86, 88, 90, 92, 94, FIG. 6, and six fasteners 96, 98, 100, 102, 104, 106, such as screws.

Figure 10:
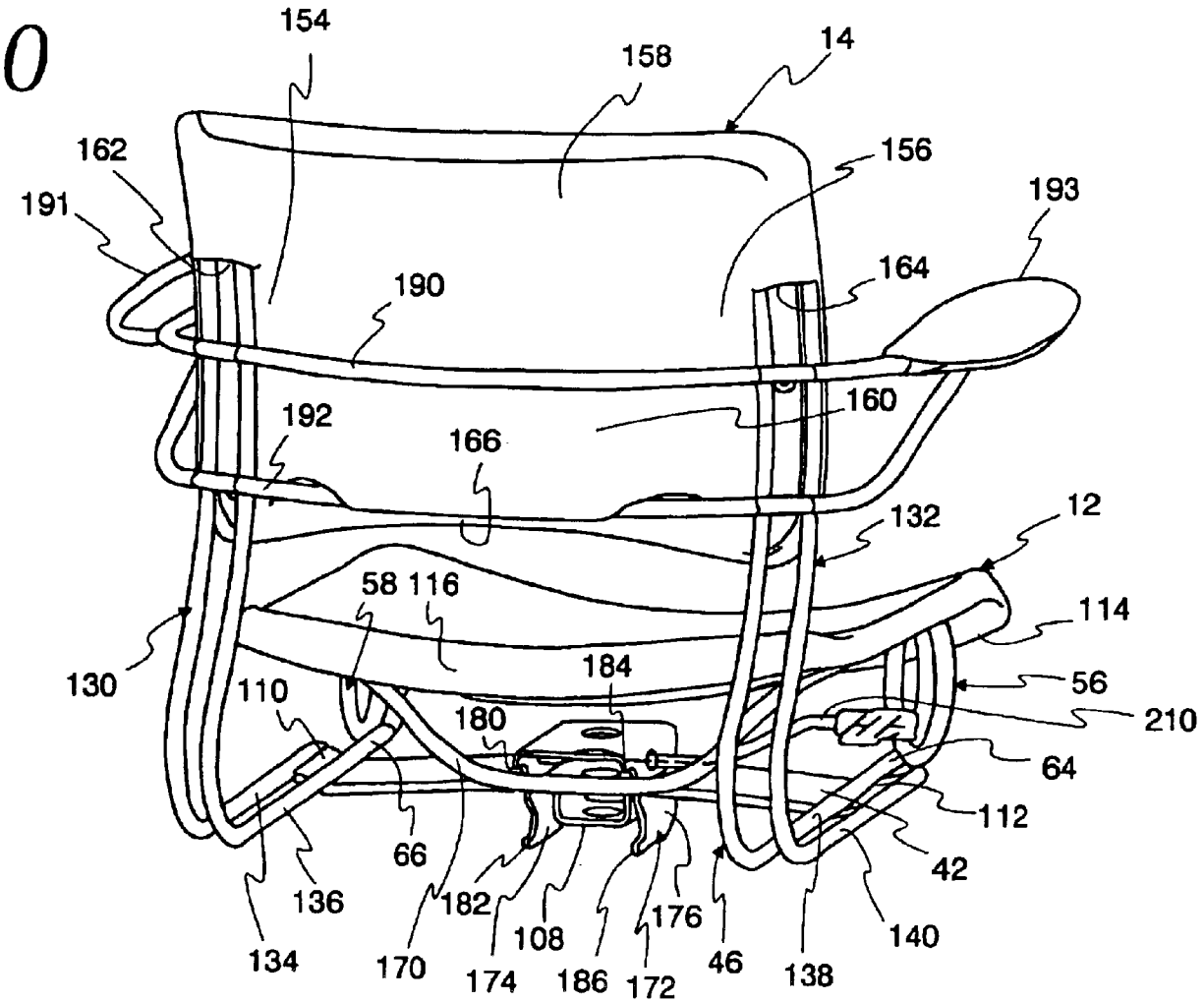
FIG. 10 is a rear isometric view of a portion of the chair showing a back frame, a seat and a backrest.

The mounting element 42 is a rectangular steel plate, slightly bent, extending from one side of the seat to the other side. A bracket 108, FIG. 10, is welded to the plate to receive the stem 18 of the base. The mounting plate has a left end portion 110 and a right end portion 112 and is positioned roughly midway between a front end portion 114 and a rear end portion 116 of the seat. The seat frame includes a forward end portion 118 and a rearward end portion 120.

The lower arm portions 64, 66 of each spring are fixedly attached, such as by welding, to the right and left end portions 110, 112 of the mounting plate. The upper arm portions 60, 62 of the springs are fixedly attached to the seat frame 44. Again, welding is the preferred means of attachment.

Figure 5:
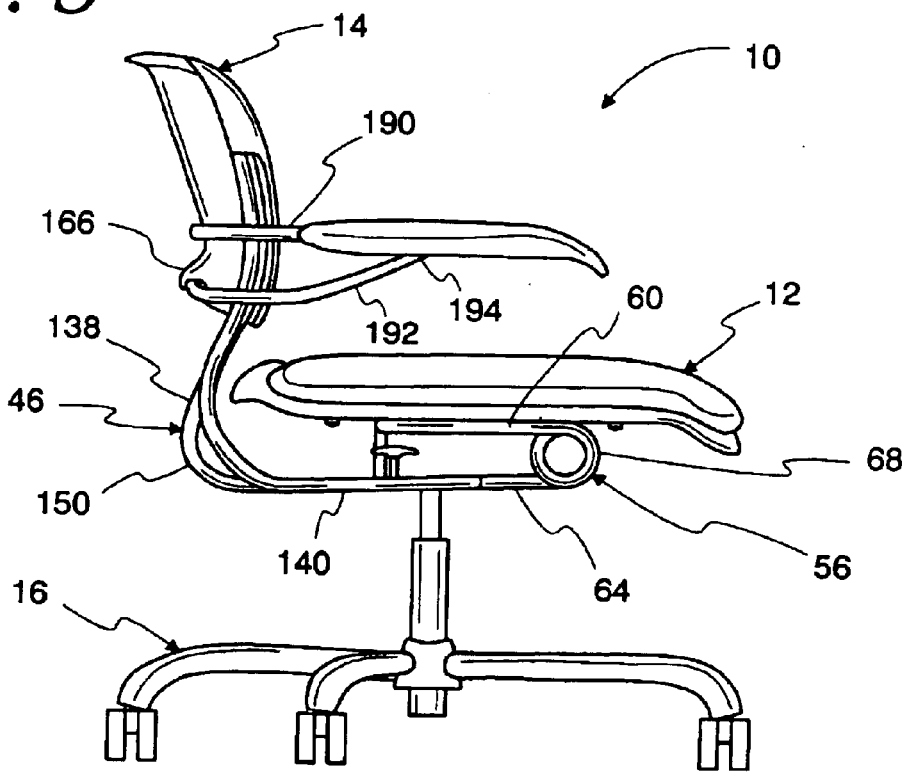
FIG. 5 is a right side elevation view of the chair shown in FIGS. 1–4.
Figure 6:
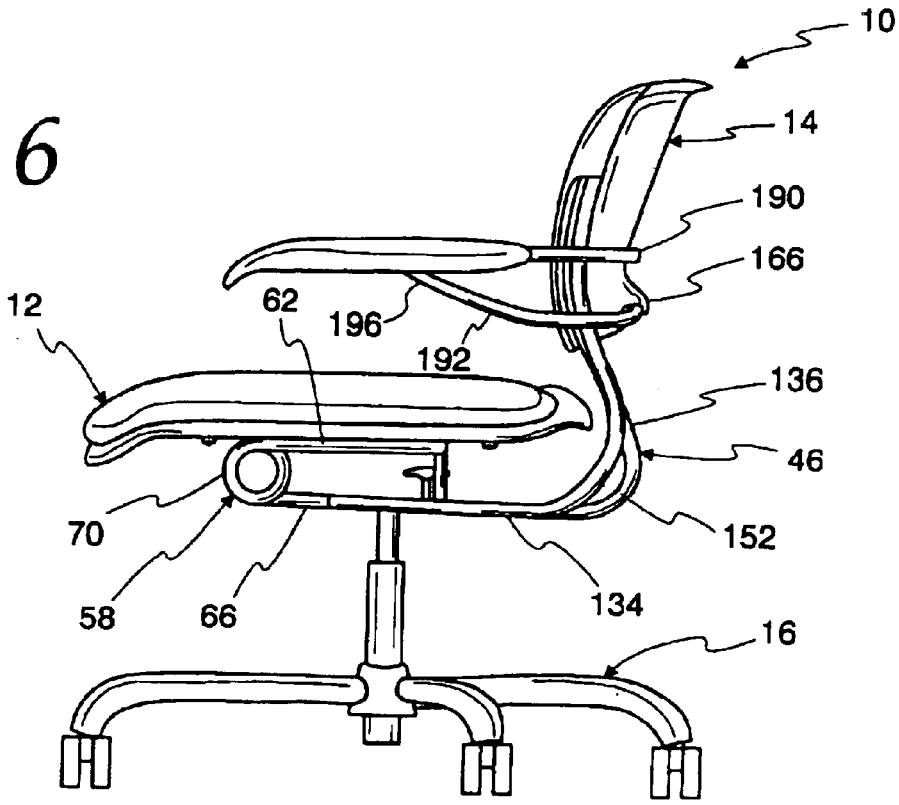
FIG. 6 is a left side elevation view of the chair shown in FIGS. 1–5.

The back frame 46 includes two generally parallel pairs of metal wires 130, 132 which are fixedly attached, such as by welding, to the mounting plate 42, a left pair 134, 136, FIG. 10, welded to the left end portion 110 of the mounting plate and a right pair 138, 140 welded to the right end portion 112 of the mounting plate. The back frame pairs 130, 132 extend generally horizontally rearwardly under the seat before gracefully curving forwardly and upwardly in graceful manner (see FIGS. 1, 2, 5, and 6) and forming a cantilever arrangement with the backrest 14. The transition from generally horizontal to generally vertical occurs in exaggerated curves 150, 152 as best shown in FIGS. 5 and 6. As shown, the inboard strands 136, 138 of the back frame pairs are contiguous with the lower arm portions 64, 66 of the springs 56, 58, again providing for a graceful appearance.

The backrest panel 52 is formed in a compound curve, as is the seat panel 48 and the backrest panel includes lateral side portions 154, 156, FIG. 10, an upper portion 158 and a lower portion 160. In the upper portion are two pockets 162, 164, each for receiving a pair of the wires of the back frame. Each pair is curved to support the lateral side portions. The backrest panel also includes a lateral lip 166 in the lower portion 160.

The spring configuration places the circular curves nearer the forward end portion of the seat frame. The lower arms of the springs are welded to the mounting plate and the upper arms are welded to the seat frame. This spring arrangement, sometimes referred to as a torsion spring, allows the rear portion of the seat to become springy or bouncy and to pivot vertically based on a user's weight and his/her shifting of this weight. Independently, the cantilevered back frame allows the backrest to also have a spring feel and move in response to the changing position of the user's body in the chair.

The seat and backrest panels 48, 52 may be made of a durable plastic, such as polyethylene. The seat and back may include the attached cushions 50, 54 but need not. The chair 10 is also comfortable without the cushions since the seat and back panels are conveniently curved for comfort.

Figure 11:
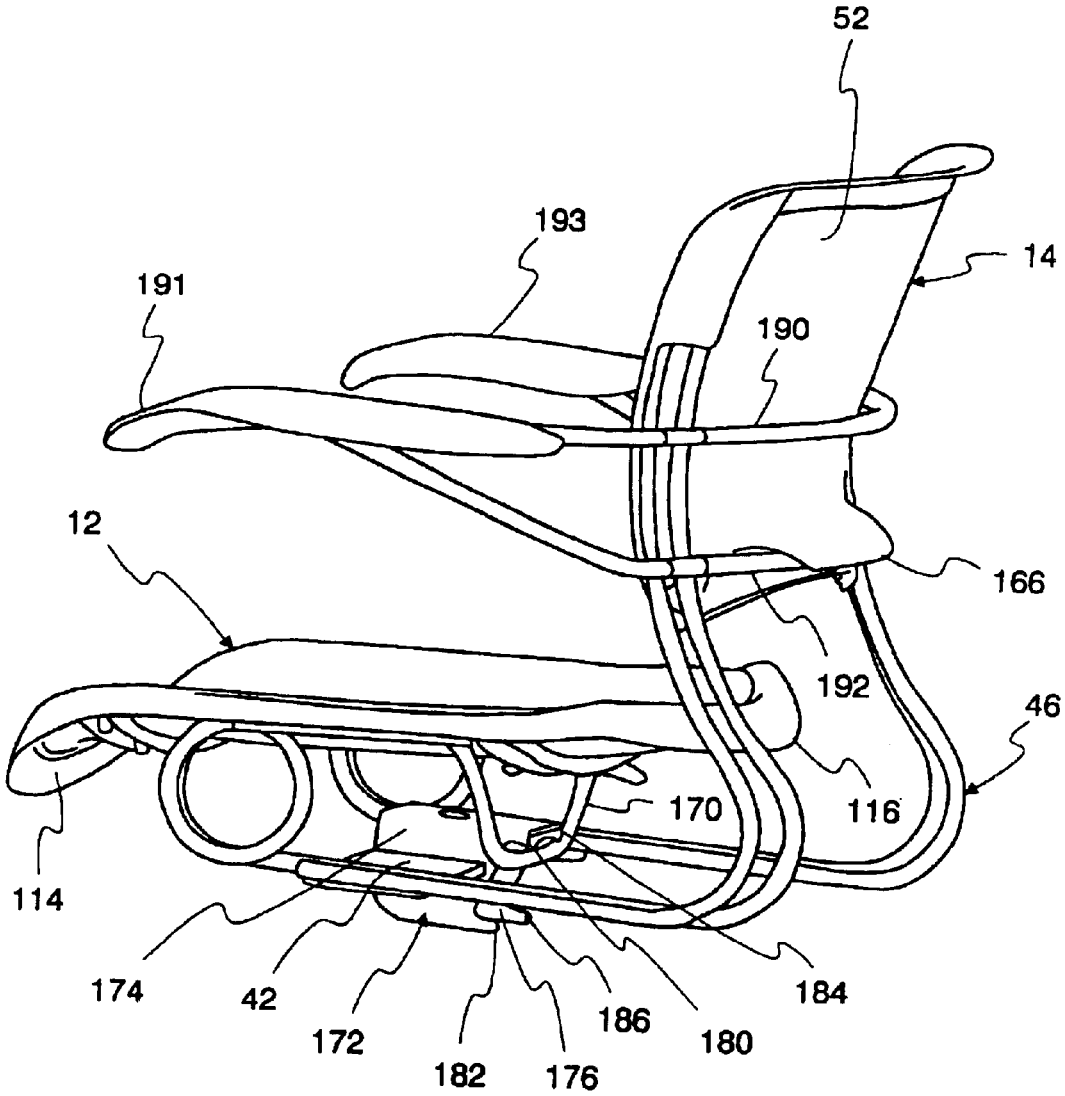
FIG. 11 is a left, rear isometric view of the chair portion shown in FIG. 10.

Referring now to FIGS. 10 and 11, the chair also includes an abutment wire 170 which is welded to the upper arms of the springs, and/or the seat frame and extends downwardly under the seat frame. The abutment wire cooperates with a bracket 172 having two arm portions 174, 176 with fingers 180, 182, 184, 186 for limiting movement of the abutment wire and thereby the pivoting of the rear portion of the seat. The bracket is welded to the mounting plate so as to capture or trap the abutment wire bar. Also welded to the center of the mounting plate between the bracket arm portion is the base bracket 108 for receiving the upper end of the base stem 18. The connection between the two allows the mounting plate, the seat frame, the seat, the back frame and the back to swivel in the usual fashion.

Figure 4:
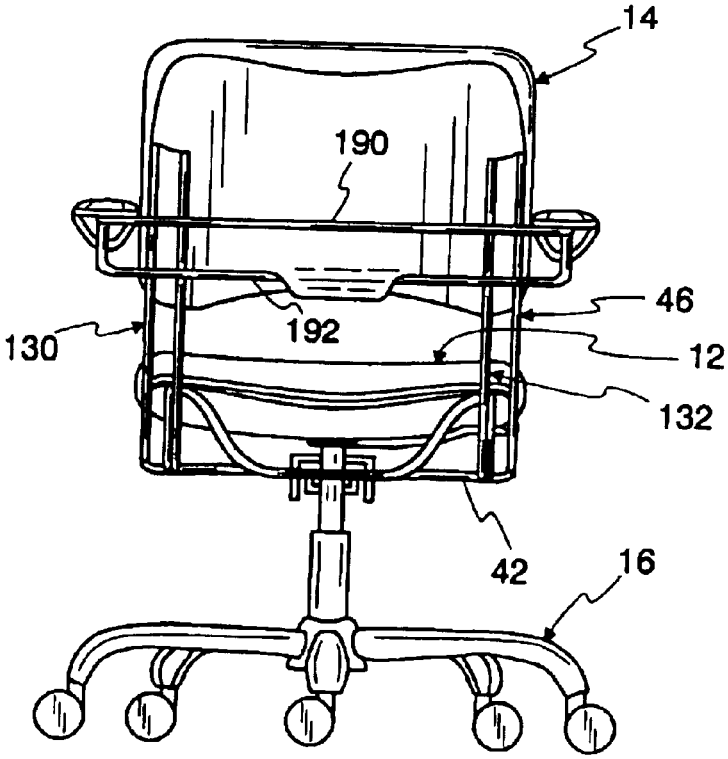
FIG. 4 is a rear elevation view of the chair shown in FIGS. 1–3.
Figure 12:
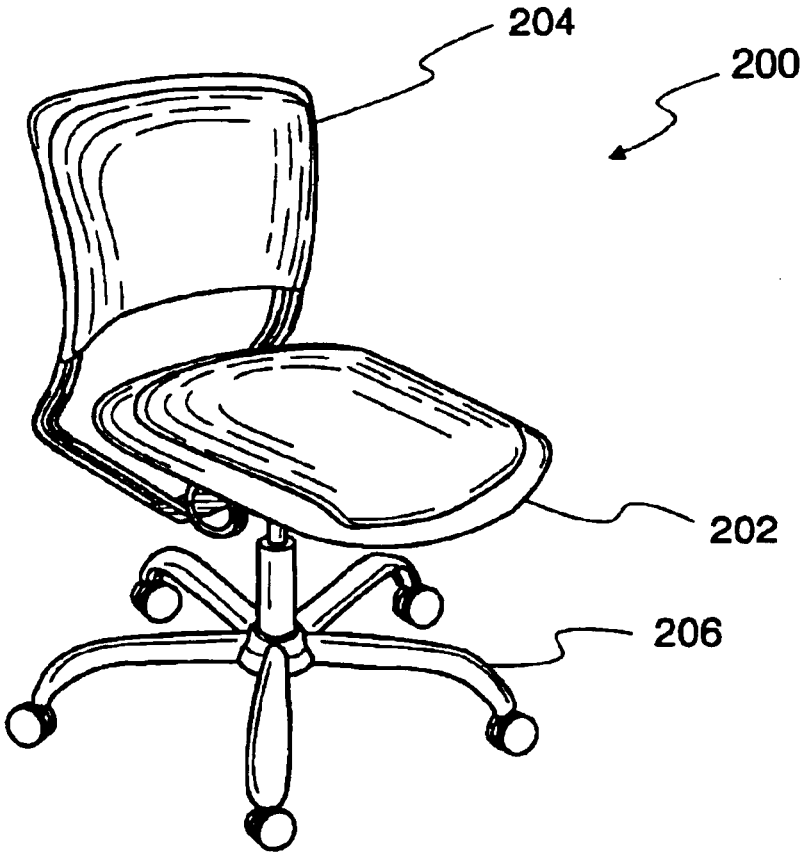
FIG. 12 is a right, front isometric view of a chair like that shown in FIGS. 1–8 but without armrests and an armrest frame.

Two generally horizontally extending but spaced metal wires 190, 192 may be added to the chair already described to support a pair of armrests 191, 193 in a springy or flexible manner. (FIGS. 4, 10 and 11.) The horizontal wires are welded to each of the pairs of back frame wires. The lower of the two horizontal wires is positioned under the lip 166 of the back panel. The cantilevered effect of the end portions 194, 196 of the horizontal wires 190, 192 allows the armrests to also have a springy feeling. FIG. 12 illustrates the embodiment of the chair 200 having no armrests or horizontal wires across the back frame. The chair 200 includes a seat 202, a backrest 204 and a base 206.

As already mentioned, when a user sits in the chair, the arrangement of the springs allow the rear portion of the seat to pivot upwardly and downwardly so as to adjust to the weight of the user or to react when the user shifts his/her weight.

The cantilever arrangement of the back frame allows the backrest to also have a springy feel and will move as a function of the user's shifting weight or position in the chair. It should again be noted that the seat moves independently of the backrest to facilitate greater comfort when using the chair.

The chair is quite versatile, and comfortable, as well as attractive, because, like many conference or task room chairs, there is a spider type base and casters for ease in moving the chair toward or away from a conference table, desk or work table and the seat and backrest may rotate in the usual fashion. Nevertheless, there is a scarcity of material giving a lightness of scale and an airy look, ideal for multiple uses in many different locations, and the open architectural styling is distinctive and recognizable. The chair is very economical to build and recyclable at the end of life. As noted above the chair can come with or without the horizontal wires and armrests.

A laterally extending lever 210 is provided for operation of the pneumatic cylinder which allows the seat and backrest to move vertically relative to the base.

In operation, a user may manipulate the chair to adjust vertical height just as he/she would operate any conference room or task chair. However, the chair is economical and yet very comfortable because of the independent flexing of the seat and back. The chair also offers a small "footprint," again increasing its versatility.

The above specification describes in detail two preferred embodiments of the present invention (with or without armrests). Other examples, embodiments, modifications and variations will, under both the literal claim language and the doctrine of equivalents, come within the scope of the invention defined by the appended claims. For example, whether the chair includes armrests or if different curves or bends are made in the metal wire, these are considered equivalent structures and will also come within the literal language of the claims. Still other alternatives will also be equivalent as will many new technologies. There is no desire or intention here to limit in any way the application of the doctrine of equivalents nor to limit or restrict the scope of the invention.

What is claimed is:

1. A chair comprising:

a base;

a pivotal seat having a longitudinally directed length and a laterally directed width;

a back;

a lateral member fixed to said base;

a seat frame formed of wire and configured in a rectangle, said seat frame being vertically spaced from said lateral member;

a first pair of wire frame members attached at one end to said lateral member and at another end to said back, said first pair of wire frame members extending longitudinally; and a second pair of wire frame members attached at one end to said seat frame and at another end to said back, said second pair of wire frame members extending generally parallel to said first pair of wire frame members and being of the same dimension, and each of said wire frame members of said second pair of wire frame members including a coil of about 540 degrees and an intermediate portion attached to said lateral member.

2. The chair of claim 1, including:

first and second laterally extending wire frame members fixed to said first and said second pairs of wire frame members, said first and said second laterally extending wire frame members being bent to extend longitudinally and to support a pair of armrests.

3. The chair of claim 2, wherein:

said first and said second laterally extending wire frame members have end portions for supporting said pair of armrests.

4. The chair of claim 2, wherein:

said back includes a back panel having a lip; and said first and said second laterally extending wire frame members include one upper wire frame member and one lower wire frame member wherein said lower wire frame member engages said lip.

5. The chair of claim 1, wherein:

said seat includes a forward end portion and wherein said coils of said second pair of wire frame members are positioned nearby.

6. The chair of claim 5, including:

an abutment wire attached to said seat frame; and a bracket attached to said lateral member wherein said bracket limits the movement of said abutment wire and thereby movement of said seat.

7. The chair of claim 6, including: a back panel having pockets for receiving ends of said first and said second pairs of wire frame members.

8. The chair of claim 7, wherein:

said seat is movable on said second pair of wire frame members and said back is movable on both said first and said second pairs of wire frame members.

9. The chair of claim 8, including:

first and second laterally extending wire frame members fixed to said first and said second pairs of wire frame members, said first and said second laterally extending wire frame members being bent to extend longitudinally and to support a pair of armrests.

10. The chair of claim 9, wherein:

said first and said second laterally extending wire frame members have end portions for supporting said pair of armrests.

11. The chair of claim 1, wherein:

said seat moves independently of said back.

12. The chair of claim 1, including:

an abutment wire attached to said seat frame; and a bracket attached to said lateral member wherein said bracket limits movement of said abutment wire and thereby movement of said seat.

13. The chair of claim 1, wherein:

said back includes a back panel having pockets for receiving ends of said first and said second pairs of wire frame members.

14. The chair of claim 1, wherein:

said seat is movable on said second pair of wire frame members and said back is movable on both said first and said second pairs of wire frame members.

15. The chair of claim 14, wherein:

said first and said second pairs of wire frame members loop upwardly; and said second pair of wire frame members loop further longitudinally rearwardly than said first pair of wire frame members.

16. The chair of claim 14, wherein:

said seat moves independently of said back.

17. The chair of claim 16, wherein:

said first and said second pairs of wire frame members loop upwardly; and said second pair of wire frame members loop further longitudinally rearwardly than said first pair of wire frame members.

18. An office chair comprising:

a base including a plurality of spokes mounted to casters and a vertically adjustable stem extending upwardly from said plurality of spokes;

a pivotally mounted seat having a longitudinally directed length and a laterally directed width;

a back;

a mounting plate fixed to said adjustable stem and extending laterally generally parallel to said seat and spaced therefrom;

a seat frame formed of wire and configured generally in a rectangle connected to said seat, said seat frame being vertically spaced from said mounting plate and extending generally parallel thereto;

a first pair of wire frame members attached at first ends to said mounting plate and having portions extending longitudinally rearwardly parallel to and spaced from said seat frame and portions curving upwardly to attach to said back at second ends of said first pair of wire frame members; and a second pair of wire frame members attached at first ends to said seat frame and having portions extending longitudinally forwardly to form coils and portions extending rearwardly from said coils to attach to said mounting plate and be generally parallel to said first pair of wire frame members, said second pair of wire frame members having portions curving upwardly to attach to said back at second ends of said second pair of wire frame members, said second pair of wire frame members being of the same dimension as said first pair of wire frame members.

19. The chair of claim 18, including:

first and second laterally extending wire frame members fixed to said first and said second pairs of wire frame members, said first and said second laterally extending wire frame members being bent to extend longitudinally and to support a pair of armrests.

20. The chair of claim 19, wherein:

said first and said second laterally extending wire frame members have end portions for supporting said pair of armrests.

21. The chair of claim 19, wherein:

said back includes a back panel having a lip; and said first and said second laterally extending wire frame members include one upper wire frame member and one lower wire frame member wherein said lower wire frame member engages said lip.

22. The chair of claim 18, wherein:

said seat includes a forward end portion and wherein said coils of said second pair of wire frame members are positioned nearby said seat forward end portion.

23. The chair of claim 22, wherein:

said seat moves independently of said back.

24. The chair of claim 23, including:

an abutment wire attached to said seat frame; and a bracket attached to said mounting plate wherein said bracket limits movement of said abutment wire and thereby movement of said seat.

25. The chair of claim 24, wherein:

said back includes a back panel having pockets for receiving said second ends of said first and said second pairs of wire frame members.

26. The chair of claim 18, wherein:

said seat is movable on deflection of said second pair of wire frame members and said back is movable on deflection of both of said first and said second pairs of wire frame members.

27. The chair of claim 18, wherein:

said first and said second pairs of wire frame members loop upwardly; and said second pair of wire frame members loop further longitudinally rearwardly than said first pair of wire frame members.

28. The chair of claim 18, wherein:

an abutment wire attached to said seat frame; and a bracket attached to said mounting plate wherein said bracket limits the movement of said abutment wire and thereby movement of said seat.

29. The chair of claim 28, wherein:

a back panel having pockets for receiving second ends of said first and said second pairs of wire frame members.

30. The chair of claim 18, wherein:

said coils each extends approximately 540°.

* * * * *